United States Patent [19]

Kasama et al.

[11] Patent Number: 4,729,946

[45] Date of Patent: Mar. 8, 1988

[54] SILVER HALIDE PHOTOGRAPHIC LIGHT-SENSITIVE MATERIAL

[75] Inventors: Yasuo Kasama; Kiyohiko Yamamuro, both of Kanagawa, Japan

[73] Assignee: Fuji Photo Film Co., Ltd., Kanagawa, Japan

[21] Appl. No.: 933,311

[22] Filed: Nov. 19, 1986

Related U.S. Application Data

[63] Continuation of Ser. No. 697,198, Feb. 1, 1985, abandoned.

[30] Foreign Application Priority Data

Feb. 1, 1984 [JP] Japan ..... 59-16280

[51] Int. Cl.[4] ..... G03C 1/36; G03C 1/10; G03C 1/34

[52] U.S. Cl. ..... 430/567; 430/591; 430/606; 430/569; 430/611; 430/264; 430/949; 430/605

[58] Field of Search ..... 430/567, 591, 606, 569, 430/611, 264, 949, 605

[56] References Cited

U.S. PATENT DOCUMENTS

| | | | |
|---|---|---|---|
| 3,859,100 | 1/1975 | Kondo et al. | 430/600 |
| 4,173,483 | 11/1979 | Habu et al. | 430/603 |
| 4,469,783 | 9/1984 | Kuwabara et al. | 430/600 |

*Primary Examiner*—Won H. Louie
*Attorney, Agent, or Firm*—Sughrue, Mion, Zinn, Macpeak & Seas

[57] ABSTRACT

A silver halide photographic light-sensitive material is disclosed, comprising a monodisperse silver halide emulsion of 0.30 μm or less in average silver halide grain size containing at least 75 mol % silver chloride and 2 mol % or less silver iodide, and having incorporated in said emulsion a dye represented by the formula (I)

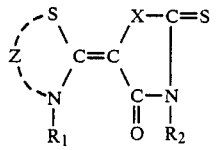

(I)

wherein

Z represents atoms forming a thiazoline nucleus, a thiazole nucleus, or a benzothiazole nucleus, X represents an oxygen atom or a sulfur atom, and $R_1$ and $R_2$ each represents an unsubstituted or substituted aliphatic group or an unsubstituted or substituted aromatic group.

18 Claims, No Drawings

SILVER HALIDE PHOTOGRAPHIC LIGHT-SENSITIVE MATERIAL

This is a continuation of application Ser. No. 697,198, filed Feb. 1, 1985 and now abandoned.

FIELD OF THE INVENTION

This invention relates to a silver halide photographic light-sensitive material, and, more particularly, to a silver halide photographic light-sensitive material useful in the field of graphic arts, which can be safely handled for long periods of time under safelight of a wavelength longer than that of yellow light and which can give contrasty photographic properties, while maintaining high sensitivity the light employed for exposure.

BACKGROUND OF THE INVENTION

In the field of graphic arts, it has been strongly desired to conduct complicated operations (particularly contact-printing procedures (commonly called "contact work")) under bright circumstances. As one technique for meeting this desire, silver halide photographic light-sensitive materials have been developed which do not cause serious fog when handled for a long time under safelight having a wavelength of yellow or longer than yellow light (that is, yellow lamps, bright green lamps, bright red lamps, etc.; since yellow lamps are brightest, the safelight will be represented by yellow safelight hereinafter).

However, as a result of giving special weight to prevention of fog formation under safelight, conventional light-sensitive materials for photomechanical process to be handled under yellow safelight have low sensitivity for light of the exposure wavelength region and show somewhat unsatisfactory photographic properties.

In order to enhance sensitivity of silver halide photographic light-sensitive materials, techniques have been employed of strengthening the degree of chemical sensitization (e.g., reduction sensitization, noble metal sensitization, sulfur sensitization, etc.), and/or using spectral sensitizing dyes.

However, excessive strengthening of the chemical sensitization results in extremely increased fog and deteriorated preservability, and hence sensitivity of light-sensitive materials for photomechanical process to be handled under safelight cannot be fully enhanced by this technique only.

Thus, it is considered desirable to enhance spectral sensitivity to light of the exposure wavelength region, particularly blue light, by using sensitizing dyes. Many blue-region spectrally sensitizing dyes have a side absorption in the yellow safelight wavelength region (e.g. light that has been filtered with Kodak Safelight Filter OA Kodak Safelight Filter OO, both made by Eastman Kodak Co.), and hence they have the defects of causing fog or having no adaptability for rapid access type developers for obtaining contrasty photographic properties (i.e., having a gamma value of more than 3), infectious developers, contrasty developers described in U.S. Pat. No. 4,452,882 corresponding to Japanese Patent Application (OPI) No. 190,943/83 (the term "OPI" as used herein refers to a "published unexamined Japanese patent application"), etc., thus not being practically usable.

SUMMARY OF THE INVENTION

It is, therefore, an object of the present invention to provide a silver halide photographic light-sensitive material suited for use in photomechanical processes, which has high sensitivity, which gives contrasty photographic properties, and which, even when handled for a long period of time under yellow safelight, undergoes less fogging.

This and other objects of the present invention will become more apparent from the following description.

As a result of extensive investigations with respect to dyes whose longer wavelength end of the spectral wavelength absorption region lies to the shorter wavelength side of the absorption end of conventional yellow safelight filters (e.g., aforesaid Kodak Safe Light Filters OA or OO) among sensitizing dyes having adaptability for the contrasty developers, the inventors have surprisingly found that dyes being about the same in longer wavelength end of spectrally sensitizing region do not necessarily form the same fog under a safelight, but that only dyes of special structure have high sensitivity and form less fog under yellow safelight conditions, and thus the present invention has been achieved based on the above described finding.

Thus, the objects of the present invention are attained by a silver halide photographic light-sensitive material comprising a monodisperse silver halide emulsion of 0.30 μm or less in average silver halide grain size containing at least 75 mol % silver chloride and 2 mol% or less silver iodide, and having incorporated in said emulsion a dye represented by formula (I)

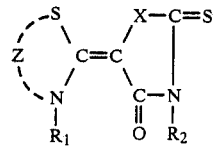

(I)

wherein

Z represents atoms forming a thiazoline nucleus, a thiazole nucleus, or a benzothiazole nucleus, X represents an oxygen atom or a sulfur atom, and $R_1$ and $R_2$ each represents an unsubstituted or substituted aliphatic group or an unsubstituted or substituted aromatic group.

DETAILED DESCRIPTION OF THE INVENTION

The silver halide emulsion to be used in the present invention has a halide composition comprising at least 75 mol% silver chloride and 2 mol% or less silver iodide. It is preferred that the halide composition contains no silver iodide.

The silver halide emulsion to be used in the present invention is a monodisperse emulsion having a narrow grain size distribution, particularly an emulsion wherein 90% or more, preferably 95% or more, grains of silver halide grains on a number on weight basis fall within ±40% of the average grain size.

The silver halide grains to be used in the present invention are as fine as 0.3 μm or less, and preferably 0.26 μm or less, in average grain size.

The term "average grain size" is commonly used by those skilled in the silver halide photographic art and is well understood. The term "grain size" means the diameter of the grains when the grains are spherical or approximately spherical. With cubic grains, the grain size refers to the length of an edge $x\sqrt{4/\pi}$.

The average grain size is determined as an algebraic average or geometric average based on the projected area of the grains. Details of the average grain size are described in C. E. Mees & T. H. James, *The Theory of the Photographic Process,* 3rd. Ed., pp. 36–43, Macmillan, New York (1976).

Silver halide emulsions not satisfying these requirements are liable to cause fog under yellow safelight and do not show contrasty photographic properties, and thus are not used for the present invention.

It is the dyes of the special structure represented by formula (I) that can enhance only light sensitivity to light of the exposure wavelength region (ultraviolet to blue region) without enhancing sensitivity to yellow safe light.

Dyes of structures other than that represented by formula (I), such as dyes wherein the basic nucleus is an oxazole or benzoxazole nucleus, cause fog under yellow safelight, even though they have characteristics similar to dyes of formula (I) in the longer wavelength end of the spectral wavelength region. Therefore, dyes of the structure represented by formula (I) in accordance with the present invention along enable attaining the objects of the present invention.

Formula (I) is described in more detail below.

In formula (I), Z represents atoms forming a thiazoline nucleus, a thiazole nucleus (e.g., 4-methylthiazole, 4,5-diphenylthiazole, etc.), a benzothiazole nucleus (e.g., 5-methylbenzothiazole, 6-methylbenzothiazole, 5-chlorobenzothiazole, 5-methoxybenzothiazole, 5-carboxybenzothiazole, 5,6-dimethylbenzothiazole, etc.), etc. Preferably Z represents atoms forming a thiazoline nucleus.

X represents an oxygen atom or a sulfur atom, with a sulfur atom being preferred.

As the aliphatic group represented by $R_1$ or $R_2$, an alkyl group is preferable, with an alkyl group containing from 1 to 5 carbon atoms (e.g., methyl, ethyl, propyl, butyl, isobutyl, pentyl, etc.) being particularly preferable. The aliphatic group may optionally include a substituent such as a sulfo group, a carboxy group, or an aryl group preferably having 6 to 12 carbon atoms.

Preferred example of the aromatic group represented by $R_1$ or $R_2$, include an aryl group preferably having 6 to 12 carbon atoms, with a phenyl group or a naphthyl group being particularly preferable. The aromatic group may optionally include a substituent such as an alkoxy group having 1 to 6 carbon atoms (e.g., methoxy, ethoxy, etc.), a halogen atom, or an alkyl group having 1 to 6 carbon atoms (e.g., methyl, ethyl, etc.).

The dyes of formula (I) may be in a salt form, and an alkali metal, $HN^{\oplus}(C_2H_5)_3$, $NH(CH^{\oplus}{}_3)_3$, etc. are illustrated as counter ions of the salts.

Specific examples of the dyes represented by formula (I) are illustrated below.

(I)-1

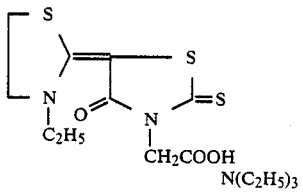

-continued (I)-2

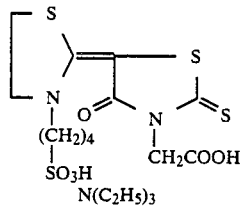

(I)-3

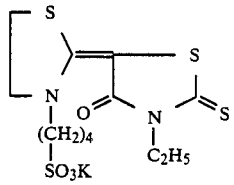

(I)-4

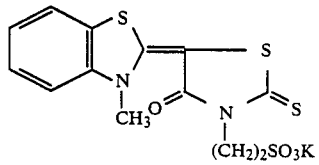

(I)-5

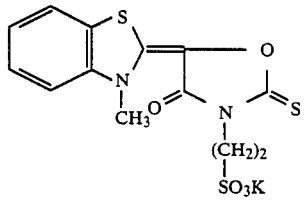

(I)-6

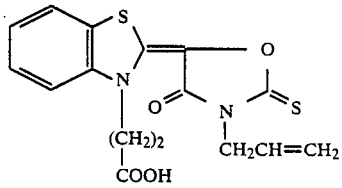

(I)-7

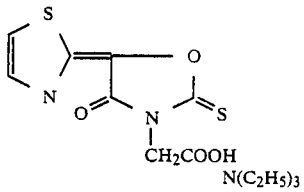

(I)-8

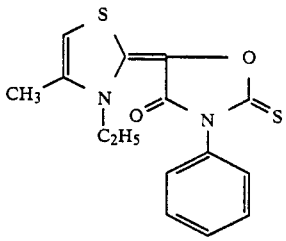

Of these, Compounds (I)-1, (I)-2 and (I)-3 are preferred.

Synthesis of Compound (I)-1

21.7 g ($7.20\times10^{-2}$ M) of 3-ethyl-2-ethylthiothiazolinium ethylsulfate and 12.5 g ($6.54\times10^{-2}$ M) of 3-carboxymethylrhodanine were dispersed in 200 ml of acetonitrile, and the resulting dispersion was refluxed while stirring. 19.8 g ($1.96\times10^{-1}$ M) of triethylamine was dropwise added thereto in 15 minutes, followed by refluxing for 40 minutes under heating. Thereafter, the mixture was allowed to cool for about 30 minutes at room temperature, then cooled with ice for 3 hours.

Crystals thus formed were collected by filtration, and washed with 100 ml of ethyl acetate. The resulting crystals were dissolved in 200 ml of methanol under refluxing, and, after filtration, 200 ml of acetonitrile was added to the filtrate, followed by concentrating the mixture to about 150 ml under atmospheric pressure. Upon ice-cooling, crystals were formed. The crystals were collected by filtration, washed with 100 ml of acetonitrile, and dried under reduced pressure to obtain 12.6 g (yield: 63.6%) of the desired product having a melting point of 136° to 138° C.

Other dyes can be synthesized in the same manner.

In the present invention, the dye represented by formula (I) is preferably used in an amount of from 10 mg to 600 mg, and more preferably from 100 mg to 400 mg, per mol of silver halide (or from 0.1 to 20 mg, and more preferably from 1 to 10 mg, per $m^2$ of the support).

The silver halide grains may be in a regular crystal form, such as cubic or octahedral form, in an irregular crystal form such as spherical or platy form, or in a mixed form thereof, or may comprise a mixture of grains in different forms, thus not being particularly limited.

The silver halide grains may have an inner portion and a surface layer different from, or the same as, each other in phase composition, i.e., a so-called shell/core structure.

Two or more silver halide emulsions that have been separately prepared may be mixed for use.

The pH upon formation of the silver halide grains is not particularly limited, and the formation may be conducted under acidic, neutral or alkaline conditions, with acidic conditions being preferable according to the experiments of the inventors of the present invention. The pH is preferably 6 or less, and more preferably 5 or less.

As a manner of reacting a soluble silver salt with a soluble halide salt, any of single jet process, double jet process, and their combination may be employed.

A process of forming grains in the presence of excess silver ion the so-called reverse mixing process) can be employed as well. As one type of double jet process, a process called the controlled double jet process, wherein the pAg in a liquid phase in which silver halide is formed is kept constant, can be employed. This process provides a silver halide emulsion containing silver halide grains of regular crystal form having an approximately uniform grain size.

Upon formation of silver halide grains, the use of silver halide solvent is desirable for controlling growth of the grains and making them monodisperse type. Examples of the silver halide solvents include ammonia, potassium rhodanate, antimony rhodanate, thioether compounds (described, for example, in U.S. Pat. Nos. 3,271,157, 3,574,628, 3,704,130, 4,297,439, 4,276,374, etc.), thione compounds (described, for example, in British Pat. No. 1,586,412 and Japanese Patent Application (OPI) Nos. 82,408/78, 77,737/80, etc.), amine compounds (described, for example, in Japanese Patent Application (OPI) No. 100,717/79, etc.), etc.

Solvents particularly preferably used for the present invention are compounds represented by the following formula (II) (tetra-substituted thiourea compounds), formulae (IIIA) and (IIIB) (organic thioether compounds), and formula (IV).

Silver halide solvents of the formulae (II), (IIIA) and (IIIB), and (IV) are particularly preferable since they give silver halide emulsions having a wide developing latitude for contrasty developers.

Silver halide solvents of tetra-substituted thiourea preferably used in the present invention are represented by the following formula (II)

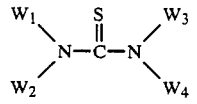

wherein $W_1$, $W_2$, $W_3$, and $W_4$ (which are the same or different) each represents a substituted or unsubstituted alkyl group, a substituted or unsubstituted alkenyl group (e.g., an allyl group, etc.), or a substituted or unsubstituted aryl group, with the sum of the carbon atoms in $W_1$ through $W_4$ being preferably up to 30, or $W_1$ and $W_2$, $W_2$ and $W_3$, or $W_3$ and $W_4$, taken together, represent a 5- or 6-membered heterocyclic ring (e.g., imidazolidinethione, piperidine, morpholine, etc.). As the alkyl group, either straight chain or branched chain alkyl groups are used.

Substituents for the alkyl group include a hydroxy group, a carboxy group, a sulfonic acid group, an amino group, an alkoxy group (O-alkyl) containing from 1 to 5 carbon atoms in the alkyl moiety, a phenyl group, and a 5- or 6-membered heterocyclic group (e.g., furan). Substituents for the aryl group include a hydroxy group, a carboxy group, and a sulfonic acid group.

Particularly preferably, three or more of $W_1$ to $W_4$ represent alkyl groups containing from 1 to 5 carbon atoms, and the aryl group is a phenyl group, with the sum of the carbon atoms contained in $W_1$ to $W_4$ being up to 20.

Examples of the compounds of formula (II) usable in the present invention are illustrated below.

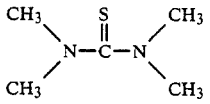

II-1

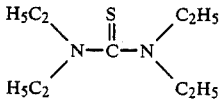

II-2

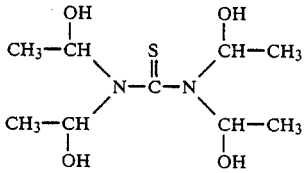

II-3

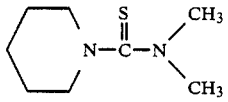

II-4

-continued

II-5

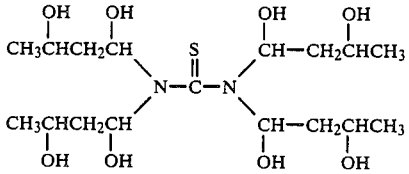

II-6

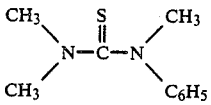

II-7

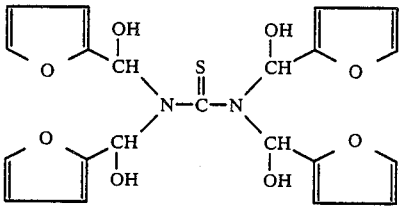

II-8

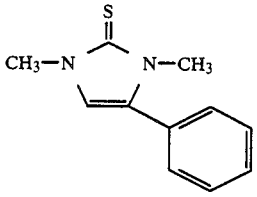

II-9

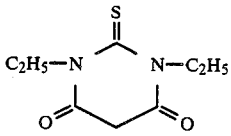

II-10

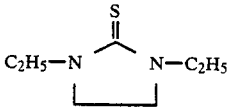

II-11

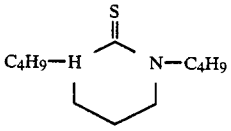

II-12

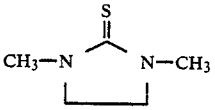

Organic thioether solvent compounds to be used in the present invention preferably include those represented by the following formulae (IIIA) and (IIIb)

$$Q-[(CH_2)_r-CH_2-S-(CH_2)_2-X'-(R)_p-(CH_2-)_2-(R')_q-S-CH_2-(CH_2)_m-Z')_n \quad \text{(IIIA)}$$

$$Q-(CH_2)_m-CH_2-S-(CH_2)_n-S-CH_2-(CH_2-)_r-Z' \quad \text{(IIIB)}$$

wherein r and m each represents an integer of 0 to 4;

n represents an integer of 1 to 4;

p and q each represents an integer of 0 to 3;

X' represents an oxygen atom, a sulfur atom,

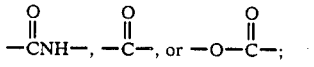

R and R' each represents an ethylene oxide group;

Q and Z' each represents —OR'',

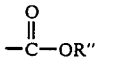

(wherein R'' represents hydrogen atom or alkyl group containing from 1 to 5 carbon atoms),

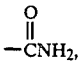

a substituent defined above as X', or may be bound to each other to form a cyclic compound.

More preferable compounds of those represented by formula (IIIA) and (IIIB) are represented by the following formulae (IIIC) through (IIIH).

$$HO-R^3-(S-R^5)_{r'}-S-R^3-OH \quad \text{(IIIC)}$$

$$(HO-R^3-S-R^3-O-R^5-)_2 \quad \text{(IIID)}$$

$$(R^4-O-R^3-S-R^3-\overset{O}{\overset{\|}{C}}-NH-R^5-)_2 \quad \text{(IIIE)}$$

$$(R^4-O-R^3-S-R^3-)_2S \quad \text{(IIIF)}$$

$$(R^4-NH-\overset{O}{\overset{\|}{C}}-R^3-S-R^3-)_2O \quad \text{(IIIG)}$$

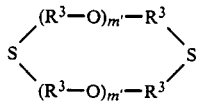

(IIIH)

wherein r' represents an integer of 0 to 3;

m' represents an integer of 1 to 2;

$R^3$ and $R^5$ each represents an alkylene group containing from 1 to 5 carbon atoms, such as a methylene group or an ethylene group; and $R^4$ represents an alkyl group containing from 1 to 5 carbon atoms, such as an ethyl group.

Specific examples of the organic thioether solvent compounds preferably used in the present invention are illustrated below:

Compound Examples

| | |
|---|---|
| $HO(CH_2)_2-S-(CH_2)_2-S-(CH_2)_2OH$ | III-1 |
| $HO(CH_2)_3-S-(CH_2)_2-S-(CH_2)_3OH$ | III-2 |
| $HO(CH_2)_2-S-(CH_2)_2-S-(CH_2)_2-S-(CH_2-)_2OH$ | III-3 |
| $[HO-(CH_2)_2-S-(CH_2)_2O-CH_2-]_2$ | III-4 |
| $[HO-(CH_2)_5-S-(CH_2)_5O-(CH_2)_2-]_2$ | III-5 |
| $[H_5C_2-O-(CH_2)_2-S-(CH_2)_2-]_2S$ | III-6 |
| $[H_3C-O-(CH_2)_4-S-(CH_2)_4-]_2S$ | III-7 |

III-8

$$[H_3C-NH-\overset{\overset{\large O}{\|}}{C}-(CH_2)_2-S-(CH_2)_2-]_2O$$

III-9

$$[H_5C_2-NH-\overset{\overset{\large O}{\|}}{C}-(CH_2)_3-S-(CH_2)_3-]_2O$$

III-10

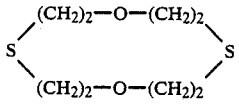

III-11

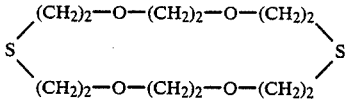

III-12

$$[NH_2CO(CH_2)_2-S-(CH_2)_2CONH-CH_2-]_2$$

III-13

$$HOOC-CH_2-S-(CH_2)_2-S-CH_2-COOH$$

III-14

$$HOCH_2\underset{\underset{\large OH}{|}}{CH}CH_2-S-CH_2CH_2-S-CH_2\underset{\underset{\large OH}{|}}{CH}CH_2OH$$

III-15

$$[H_3C-O-(CH_2)_2-S-(CH_2)_2-\overset{\overset{\large O}{\|}}{C}-NH-CH_2-]_2$$

Preferable silver halide solvents to be used in the present invention are represented by formula (IV)

(IV)

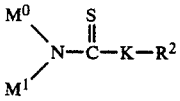

wherein

K represents a sulfur atom or an oxygen atom;

$M^0$ and $M^1$ which may be the same or different each represents an aliphatic group (for example, an alkyl group containing 1 to 4 carbon atoms and being unsubstituted or substituted by a carboxy group, a sulfo group, a hydroxy group, an aryl group (preferably a phenyl group) or the like, more specifically a methyl group, an ethyl group, a propyl group, a butyl group, a carboxymethyl group, a carboxyethyl group, a carboxypropyl group, a sulfoethyl group, a sulfopropyl group, a sulfobutyl group, a hydroxyethyl group, a benzyl group, a phenethyl group, etc.); an aryl group (for example, an aryl group (preferably a phenyl group) unsubstituted or substituted by an alkyl group (preferably containing from 1 to 4 carbon atoms), a sulfo group, an alkoxy group (preferably containing from 1 to 4 carbon atoms in the alkyl moiety), a halogen atom, or the like, more specifically a phenyl group, a 2-methylphenyl group, a 4-sulfophenyl group, a 4-ethoxyphenyl group, a 4-chlorophenyl group, etc.); a hetero ring residue (for example, a 5- or 6-membered, nitrogen-containing residue, such as a 2-pyridyl group, a 3-pyridyl group, a 4-pyridyl group, etc.); or an amino group (preferably a substituted amino group such as an arylamino group (the aryl moiety preferably being a phenyl group, unsubstituted, or substituted by a substituent such as an alkyl group, a sulfo group, a carboxy group, etc.), such as a 4-sulfophenylamino group, etc.);

$M^0$ and $M^1$ may be bound to each other to form a 5- or 6-membered hetero ring (e.g., a piperidine ring, a morpholine ring, a piperazine ring, etc.); and $R^2$ represents an aliphatic group (for example, an alkyl group containing from 1 to 4 carbon atoms and being unsubstituted or substituted by a substituent such as a carboxy group, a sulfo group, a hydroxy group, an aryl group (e.g., a phenyl group), etc., more specifically a methyl group, an ethyl group, a propyl group, a butyl group, a carboxymethyl group, a carboxyethyl group, a carboxypropyl group, a sulfoethyl group, a sulfopropyl group, a sulfobutyl group, a hydroxyethyl group, a benzyl group, a phenethyl group, etc.); an aryl group (for example, an aryl group (preferably a phenyl group) unsubstituted or substituted by a substituent such as an alkyl group (preferably containing from 1 to 4 carbon atoms), a sulfo group, an alkoxy group (preferably containing from 1 to 4 carbon atoms in the alkyl moiety), a halogen atom, etc., more specifically a phenyl group, a 2-methylphenyl group, a 4-sulfophenyl group, a 4-ethoxyphenyl group, a 4-chlorophenyl group, etc.) or, $M^1$ and $R^2$ may be bound to each other to form a 5- or 6-membered hetero ring, thus forming compounds represented by the following formula (IV') (which are more preferable silver halide solvents)

(IV')

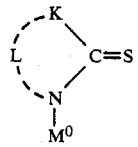

wherein

L represents atoms completing a hetero ring (including those wherein an unsaturated ring containing 5 or 6 carbon atoms (e.g., a benzene ring or a tetrahydrobenzene ring) is fused with the hetero ring; "hetero ring" has the same meaning as used hereinafter); and K and $M^0$ are the same as defined for formula (IV).

Specific examples of the silver halide solvents represented by the formula (IV) are illustrated below:

Compound No.

IV-1

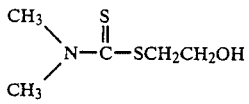

IV-2

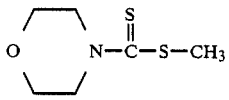

IV-3

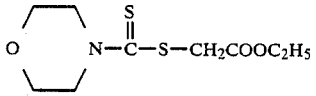

IV-4

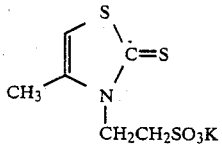

-continued

IV-5

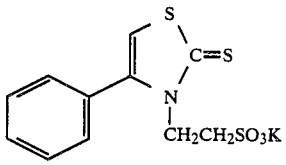

IV-6

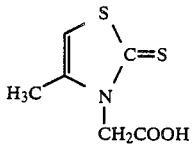

IV-7

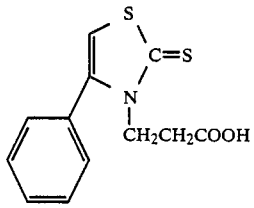

IV-8

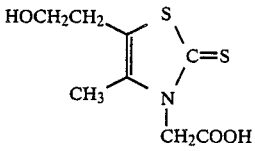

IV-9

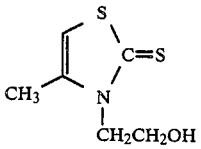

IV-10

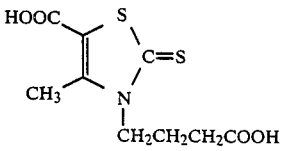

IV-11

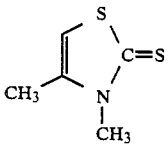

IV-12

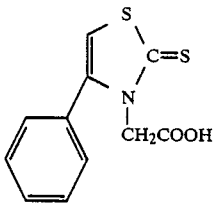

IV-13

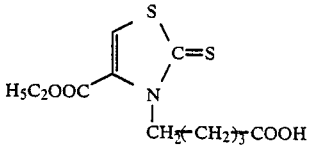

-continued

IV-14

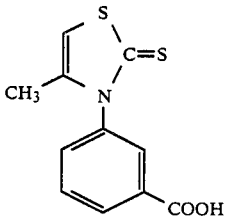

IV-15

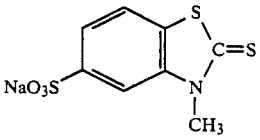

IV-16

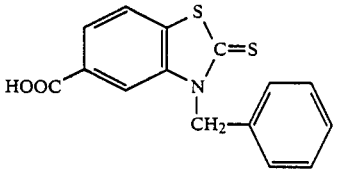

IV-17

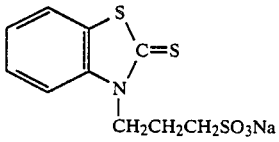

IV-18

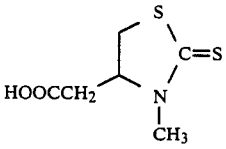

IV-19

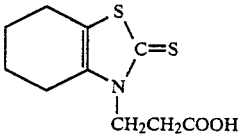

The amount of the silver halide solvent to be used in the present invention can be varied over a wide range depending upon the desired effects, properties of the particular compounds used, etc. As a general guide, the compound represented by one of formulae (II), (IIIA), (IIIB) and (IV), may be used in an amount of from about $5\times10^{-6}$ mol to about $5\times10^{-2}$ mol per mol of silver halide, with from about $1\times10^{-5}$ mol to about $2.5\times10^{-2}$ mol being particularly preferable.

In the present invention, addition of the silver halide solvent is conducted in at least one step selected from the steps between the step of forming a precipitate of silver halide grains and the subsequent physical ripening step in the steps of preparing the emulsion. Thus, the silver halide emulsion contains silver halide grains formed and/or ripened (i.e., formed, ripened, or formed and ripened) in the presence of a silver halide solvent.

Of the above-described silver halide solvents, tetra-substituted thioureas represented by formula (II) are particularly preferable for the purpose of the present invention.

During formation or physical ripening of silver halide grains, cadmium salts, zinc salts, lead salts, thallium salts, iridium salts, or complex salts thereof, rhodium salts or complex salts thereof, iron salts or complex salts thereof, etc., may be allowed to coexist.

The use of a water-soluble rhodium salt is particularly preferable in view of the objects of the present invention to make photographic properties obtained by a contrasty developer (particularly rapid access processing) contrasty and ensure working safety under yellow safelight. The dyes of the present invention represented by formula (I) can extremely effectively sensitize a silver halide emulsion containing a rhodium salt.

As the water-soluble rhodium salt to be used in the present invention, rhodium chloride, rhodium trichloride, rhodium ammonium chloride, etc., can be used. Further, complex salts thereof may also be used. In the present invention, addition of the rhodium salt must be conducted before completion of first ripening of the emulsion, and desirably it is added during formation of grains. The amount of the rhodium salt to be added preferably falls within the range of from $1\times10^{-10}$ mol to $1\times10^{-5}$ mol, and more preferably from $1\times10^{-8}$ mol to $1\times10^{-6}$ mol, per mol of silver.

As a binder or protective colloid for the photographic emulsion, gelatin is advantageously used. However, other hydrophilic colloids can be used as well. For example, proteins such as gelatin derivatives, graft polymers between gelatin and other high polymer, albumin, casein, etc.; cellulose derivatives such as hydroxyethylcellulose, carboxymethylcellulose, cellulose sulfate, etc.; sugar derivatives such as sodium alginate, starch derivative, etc.; and various synthetic hydrophilic substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinyl imidazole, polyvinyl pyrazole, etc.) can be used.

As gelatin, acid-processed gelatin or enzyme-processed gelatin may be used, as well as lime-processed gelatin, and a gelatin hydrolyzate or an enzyme-decomposed product can also be used.

After the formation of the grains or after physical ripening, the soluble salts are usually removed from the emulsion. For this purpose, the well-known noodle washing method, in which gelatin is subjected to gelation, may be used. Furthermore, a flocculation method which employs an inorganic salt having a polyvalent anion such as sodium sulfate, an anionic surface active agent, an anionic polymer (such as polystyrene sulfonic acid) or a gelatin derivative (such as an aliphatic acylated gelatin, an aromatic acylated gelatin or an aromatic carbamoylated gelatin) may be used. The removal of the soluble salts may be omitted, if desired.

Although the silver halide emulsions used in the present invention do not need to be chemically sensitized, chemically sensitized silver halide emulsions are preferred. Processes for the chemical sensitization of silver halide emulsions which can be used include known sulfur sensitization, reduction sensitization, and noble metal sensitization processes. These may be employed independently or in combination. They are described in the aforesaid texts of Glafkides or Zelikman, or in H. Frieser, *Die Grundlagen der Photographischen Prozesse mit Silberhalogeniden* (Akademische Verlagsgesellschaft, 1968).

Of noble metal sensitization processes, a gold sensitization process is a typical process; therein, a gold compound, or mainly gold complexes, are used. Complexes of noble metals other than gold, such as metals of group VIII of the Periodic Table (e.g., platinum, palladium, iridium, etc.) may be used as well. Specific examples thereof are described in U.S. Pat. Nos. 2,399,083 and 2,448,060, British Pat. Nos. 570,393 and 618,061, etc.

Examples of sulfur sensitizing agents which can be used include not only the sulfur compounds present in gelatin per se, but also various sulfur compounds such as thiosulfates, thioureas, thiazoles, rhodanines, etc. Examples of suitable sulfur compounds are described in U.S. Pat. Nos. 1,574,944, 2,278,947, 2,410,689, 2,728,668, 3,501,313, 3,656,955, etc.

The reduction sensitizing agents which can be used include stannous salts, amines, formamidine sulfinic acid, silane compounds, etc. Specific examples thereof are described in U.S. Pat. Nos. 2,487,850, 2,518,698, 2,983,609, 2,983,610, 2,694,637, etc.

For the purpose of preventing formation of fog or stabilizing photographic properties in the steps of producing, or during storage or photographic processing of, the light-sensitive material known antifogging agents or stabilizers may be added to the light-sensitive material of the present invention. Particularly, compounds having a 1,2-dithiolane ring or a 1,2-dithiane ring are preferable, since they prevent fogging and stabilize without inhibiting the sensitization effect of the dye of formula (I). Of such compounds, those preferred are represented by formula (V).

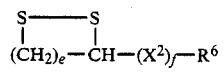

(V)

wherein $X^2$ represents a divalent organic residue containing from 1 to 6 carbon atoms;

$R^6$ represents a carboxylic acid, a carboxylic acid salt, a carboxylic ester, or a carboxylic acid amide;

e represents 2 or 3; and f represents 0 or 1.

Preferable examples of $X^2$ in formula (V) include methylene, ethylene, propylene, butylene, hexylene, etc. Preferable examples of the carboxylic acid salt include alkali metal salts (e.g., sodium salts, potassium salts, etc.), alkaline earth metal salts (e.g., calcium salts, barium salts, etc.), ammonium salts, amine salts (e.g., methylamine, ethylamine, ethanolamine, etc.), etc.

Preferable examples of the carboxylic ester include esters having an alkyl group containing from 1 to 12 carbon atoms or a phenyl group, and preferable examples of the carboxylic acid amide include carboxylic acid amides and amides substituted by an alkyl group containing from 1 to 12 carbon atoms or a phenyl group.

Additionally, it is noted that the foregoing formula (V) contains a dithiolane ring when e represents 2, or contains a dithiane ring when e represents 3.

In the present invention, any compound that contains the dithiolane ring or the dithiane ring may be used, and compounds of formula (V) are not limitative, but simply preferred.

The compounds represented by the foregoing formula (V) may be synthesized according to known processes described, for example, in *Journal of the American Chemical Society,* Vol. 76, pp. 1828–1832 (1954).

Typical useful examples of the compounds represented by formula (V) are illustrated below.

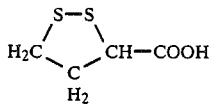

(V)-1

1,2-Dithiolane-3-methanoic acid

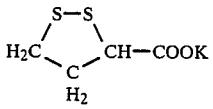

(V)-2

1,2-Dithiolane-3-methanoic acid potassium salt

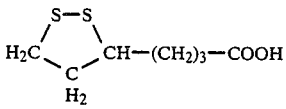

(V)-3

4-(1,2-Dithiolan-3-yl)-butanoic acid

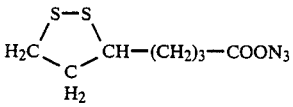

(V)-4

Sodium 4-(1,2-dithiolan-3-yl)-butanoate

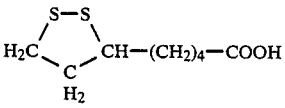

(V)-5

5-(1,2-Dithiolan-3-yl)-pentanoic acid

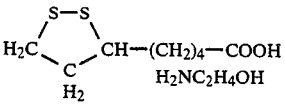

(V)-6

5-(1,2-dithiolan-3-yl)pentanoic acid monoethanolamine salt

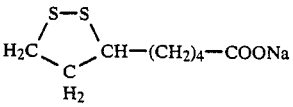

(V)-7

Sodium 5-(1,2-dithiolan-3-yl)pentanoate

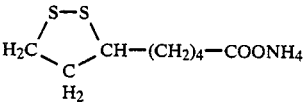

(V)-8

Ammonium 5-(1,2-dithiolan-3-yl)-pentanoate

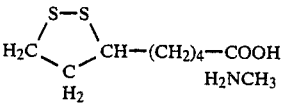

(V)-9

5-(1,2-Dithiolan-3-yl)-pentanoic acid methylamine salt

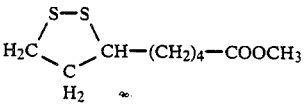

(V)-10

Methyl 5-(1,2-dithiolan-3-yl)-pentanoate

-continued

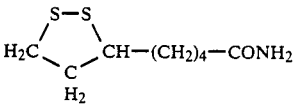

(V)-11

5-(1,2-Dithiolan-3-yl)-pentanoic acid amide

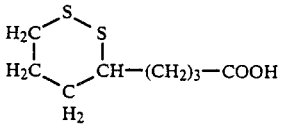

(V)-12

4-(1,2-Dithian-3-yl)-butanoic acid

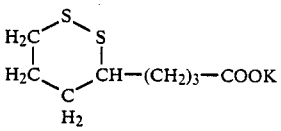

(V)-13

Potassium 4-(1,2-dithian-3-yl)butanoate

The compounds of formula (V) are preferably used in an amount of from $10^{-6}$ to $10^{-1}$ mol, and preferably $10^{-5}$ to $10^{-2}$ mol, per mol of silver halide.

Further, various compounds other than the compounds of formula (V) may be incorporated in the light-sensitive material of the present invention, for purposes such as preventing formation of fog, or stabilizing photographic properties, in the steps of producing, or during storage or photographic processing of, the light-sensitive material. That is, many compounds known as antifoggants or stabilizers, such as azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines, thioketo compounds such as oxazolinethione; azaindenes (e.g., triazaindenes, tetraazaindenes (particularly 4-hydroxy-substituted (1,3,3a,7)-tetraazaindenes), pentaazaindenes, etc.); benzenethiosulfonic acid, benzenesulfinic acid, benzenesulfonic acid amide, etc. known as antifoggants or stabilizers can be added. Of these compounds, azaindenes (particularly triazaindenes), benzotriazoles (e.g., 5-methylbenzotriazoles), and nitroindazoles (e.g., 5-nitroindazoles) are preferable. These compounds may also be incorporated in a processing solution.

The light-sensitive material of the present invention may contain various known surface active agents for various purposes, e.g., as a coating aid, for preventing the generation of static charges, improving slip characteristics, improving emulsion dispersion, preventing adhesion, improving photographic characteristics, etc.

For example, nonionic surface active agents such as saponin (steroids), polyalkylene glycol alkylamines or amides, silicone/polyethylene oxide adducts, glycidol derivatives (such as alkenylsuccinic acid polyglycerides or alkylphenol polyglycerides), aliphatic esters of polyhydric alcohols, alkyl esters of sucrose, urethanes or ethers; anionic surface active agents containing an acidic group such as a carboxylic acid group, a sulfo group, a phospho group, a sulfuric acid ester group or a phosphoric acid ester group, such as triterpenoid type saponin, alkyl carboxylates, alkyl sulfonates, alkylbenzenesulfonates, alkylnaphthalenesulfonates, alkyl sulfates, alkyl phosphates, N-acyl-N-alkyltaurines, sulfosuccinates, sulfoalkylpolyoxyethylene alkylphenyl ethers or polyoxyethylene alkylphosphates; amphoteric surface active agents such as amino acids, aminoalkylsulfonic acid, aminoalkylsulfuric acid esters, aminoalkyl phosphoric acid esters, alkylbetaines, amineimides, or amine oxides; and cationic surface active agents such as alkylamine salts, aliphatic or aromatic quaternary ammonium salts, hetero ring quaternary amine salts (such as pyridinium or imidazolium salts) or phosphonium or sulfonium salts containing an alicyclic or heterocylic ring can be used.

In the present invention, polyalkylene oxide compounds are preferably used. They include condensates between polyalkylene oxides comprising at least 10 units alkylene oxide (containing from 2 to 4 carbon atoms, e.g., ethylene oxide, propylene-1,2-oxide, butylene-1,2-oxide, etc., and preferably ethylene oxide) and compounds containing at least one active hydrogen atom (e.g., water, aliphatic alcohol, aromatic alcohol, aliphatic acid, organic amine, hexitol derivative, etc.), and block copolymers of two or more polyalkylene oxides. Thus, the polyalkylene oxide compounds include the following specific examples.

Polyalkylene glycols;
Polyalkylene glycol alkyl ethers;
Polyalkylene glycol aryl ethers;
Polyalkylene glycol (alkylaryl)esters;
Polyalkylene glycol esters;
Polyalkylene glycol fatty acid amides;
Polyalkylene glycol amines;
Polyalkylene glycol block copolymers; and
Polyalkylene glycol graft copolymers.

Specific examples of the polyalkylene oxide compounds preferably used in the present invention are illustrated below.

1. $HO(CH_2CH_2O)_9H$
2. $C_{12}H_{25}O(CH_2CH_2O)_{15}H$
3. $C_8H_{17}CH{=}CHC_8H_{16}O(CH_2CH_2O)_{15}H$

4. 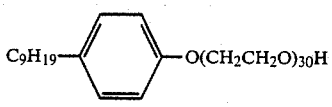

5. $C_{11}H_{23}COO(CH_2CO_2O)_{30}H$
6. $C_{11}H_{23}CONH(CH_2CH_2O)_{15}H$

7. 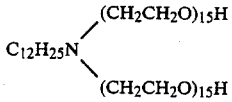

8. $C_{14}H_{29}N(CH_2)\ (CH_2CH_2O)_{24}H$

9. $H(CH_2CH_2O)_a(CH(CH_3)CH_2O)_b(CH_2CH_2O)_cH$
a+b+c=50
b:a+c=10:9

The light-sensitive silver halide photographic emulsion may contain a polymer latex comprising alkyl acrylate, alkyl methacrylate, acrylic acid, glycidyl acrylate, etc. as described, for example, in U.S. Pat. Nos. 3,411,911, 3,411,912, 3,142,568, 3,325,286, 3,526,620 and 3,546,650 for the purpose, e.g., of improving dimensional stability of the photographic material or physical properties of coatings.

The contrasty emulsion as used in the present invention is also suited for the reproduction of line images and, since dimensional stability is important in such use, incorporation of the polymer dispersion is preferred.

An inorganic or organic hardener may be incorporated in the photographic emulsion of the present invention and light-insensitive hydrophilic colloid. For example, chromium salts (such as chrome alum or chromium acetate), aldehydes (such as formaldehyde, glyxoal or glutaraldehyde), N-methylol compounds (such as dimethylolurea or methyloldimethylhydantoin), dioxane derivatives (such as 2,3-dihydroxydioxane), active vinyl compounds (such as 1,3,5-triacryloyl-hexahydro-s-triazine, or bis(vinylsulfonyl)methyl ether), N,N'-methylenebis-(β-(vinylsulfonyl)propionamide), etc.), active halogen compounds (such as 2,4-dichloro-6-hydroxy-s-triazine), mucohalogenic acids (such as mucochloric acid or mucophenoxychloric acid), isoxazoles, dialdehyde starch, 2-chloro-6-hydroxytriazinylated gelatin, and the like can be used individually or in combination.

The silver halide emulsion layer of the present invention may contain Tartrazine, oxanol dyes, dialkylaminobenzylidene dyes, etc., known as dyes having absorption in the visible region, for the purpose of preventing irradiation, etc.

However, since these dyes also have absorption in the ultraviolet region, their presence in too large an amount in an emulsion layer reduces sensitivity for ultraviolet light and makes the emulsion less contrasty due to the difference in light absorption. Thus, they are most effectively used in suitably small amounts.

Use of the dye in a suitable amount provides the advantage, particularly in the case of utilizing lithographic type development, that width of the letter line, or tone of the halftone dot image can be appropriately controlled. (Specifically, the letter line may be made somewhat thicker than the original line, or the halftone dot area may be made somewhat larger than that of the original halftone dot. In the return step, it is in some cases required to add artistic taste, in addition to accurate reproduction of the lines or the halftone dots with absolutely the same width or area as that of the original. Thus, original-modifying capability is required.

In the present invention, incorporation of dyes having absorption in green and red wavelength regions in the silver halide emulsion layer is effective for ensuring safe handling work under yellow safe light without reducing sensitivity of the silver halide emulsion.

Two or more silver halide emulsion layers may be provided if desired, but presence of a single silver halide emulsion layer usually suffices.

In the present invention, it is also effective to provide a light-insensitive hydrophilic colloidal layer on or above the above-described silver halide emulsion layer, i.e., at a position more apart from the support than the emulsion layer, and incorporate in the light-insensitive layer dyes having absorption in the blue, green, and red wavelength regions but not overlapping the intrinsic sensitivity wavelength region of the silver halide.

The light-insensitive hydrophilic colloidal layer containing such dyes may be provided in direct contact with the silver halide emulsion layer or via an interlayer. Other light-insensitive hydrophilic emulsion layers may further be provided on the dye-containing light-insensitive hydrophilic layer.

The dyes to be used in the present invention in the light-insensitive hydrophilic layer have main absorption in green and red wavelength regions excluding the absorption wavelength of dye (I). Of these, dyes having an absorption maximum in the region of from 500 to 700 nm are preferable.

The dyes are not particularly limited as to chemical structure, and oxonol dyes, hemioxonal dyes, merocyanine dyes, cyanine dyes, azo dyes, etc., may be used, but, in view of avoiding color remaining after processing, water-soluble dyes are preferable.

Specifically, pyrazoloneoxonal dyes described in U.S. Pat. No. 2,274,782, diarylazo dyes described in U.S. Pat. No. 2,956,879, styryl dyes and butadienyl dyes described in U.S. Pat. Nos. 3,423,207 and 3,384,487, merocyanine dyes described in U.S. Pat. No. 2,527,583, merocyanine dyes and oxonol dyes described in U.S. Pat. Nos. 3,486,897, 3,652,284, and 3,718,472, enaminohemioxonol dyes described in U.S. Pat. No. 3,976,661, and dyes described in British Pat. Nos. 584,609, 1,177,429, Japanese Patent Application (OPI) Nos. 85,130/73, 99,620/74, 114,420/74, U.S. Pat. Nos. 2,533,472, 3,148,187, 3,177,078, 3,247,127, 3,540,887, 3,575,704, and 3,653,905 can be used.

The above-described dyes are dissolved in a suitable solvent (for example, water, alcohol (e.g., methanol, ethanol, propanol, etc.), acetone, methyl cellosolve, etc., or a mixture thereof) and adding to a coating solution of the light-insensitive hydrophilic colloidal layer.

The dyes may be used in combinations of two or more.

The dyes are used in an amount sufficient to ensure safe handling under yellow safelight conditions.

A specific amount of the dye is not prescribed, since it varies depending upon the content of bromide in the silver halide emulsion, the grain size, the kind of dye used, etc., but, as a general guide, a preferable amount may be found in the range of from $10^{-4}$ to 1.0 g/m$^2$, and preferably from $10^{-3}$ to 0.5 g/m$^2$.

It is also effective to mordant the aforesaid dye to the light-insensitive hydrophilic layer of the present invention for the purpose of incorporating the dyes having absorption in the green and red wavelength regions in substantially only the light-insensitive hydrophilic layer.

For this purpose, the dye and a polymer mordant capable of mordanting the dye may be incorporated in the light-insensitive hydrophilic layer.

In the present invention, incorporation of the dye in substantially the light-insensitive hydrophilic colloidal layer can be attained by preventing the dye from diffusing from the light-insensitive hydrophilic colloidal layer to other emulsion layers. For example, a process may be employed of coating a silver halide emulsion layer, completely gelling the coated emulsion layer, then coating a light-insensitive hydrophilic layer containing a nondiffusible dye on the emulsion layer. In the case of coating the emulsion layer and the light-insensitive hydrophilic colloid layer at the same time according to the multi-layer coating method, it is most preferable to add a non-diffusible dye or a dye together with a polymer mordant to the light-insensitive hydrophilic colloidal layer.

The polymer mordants that can be used in the present invention include polymers containing secondary and tertiary amino groups, polymers having nitrogen-containing hetero ring moieties, polymers containing quaternary cation groups thereof, etc., generally having a molecular weight of from 5,000 to 200,000, and preferably from 10,000 50,000.

Particularly preferable polymer mordants are described in more detail, for example, in Japanese Patent Application (OPI) No. 193,447/84.

As the light-insensitive hydrophilic colloid, gelatin is most preferred, and various known gelatins are used. For example, gelatins differing in the production processes thereof, such as lime-processed gelatin, acid-processed gelatin, etc., and chemically modified gelatins such as phthaloylated gelatin or sulfonylated gelatin may be used. If desired, the gelatins may be subjected to a desalting treatment before use.

The mixing ratio of the polymer mordant to gelatin, and the amount of polymer mordant may be easily decided by those skilled in the art depending upon the amount of dye to be mordanted, kind or composition of polymer mordant, etc.

In addition, surfactants, antistatic agents, matting agents, slipping agents, colloidal silica, gelatin plasticizers, polymer latexes, etc. may be used in the light-insensitive hydrophilic colloidal layer. As the matting agent, polymethyl methacrylate or silicon dioxide preferably of from 0.1 to 10 μm, and more preferably from 1 to 5 μm, in particle size is used.

As to the process of developing the plate-making light-sensitive material of the present invention, there are no limitations, and any process employed for processing ordinary plate-making light-sensitive materials may be used. The processing temperature is usually selected between 18° and 50° C., but temperatures lower than 18° C. or higher than 50° C. may be selected.

Developers to be used in the present invention may contain known developing agents. As the developing agent, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds such as those wherein a 1,2,3,4-tetrahydroquinoline ring is fused with an indolene ring described in U.S. Pat. No. 4,067,872 may be used, alone or in combination.

In addition, the developer generally contains known additives such as a preservative, an alkali agent, a pH buffer, an antifogging agent, and, if desired, the developer may further contain a dissolving aid, a toning agent, a development accelerator, a surface active agent, a defoaming agent, a water softener, a hardener, a thickening agent, etc. as described, e.g., in *Research Disclosure* 17643, No. 176 (November 1978).

If desired, it may further contain a silver transfer stain-preventing agent (preferably, 2-mercaptobenzimidazole, etc.).

The developer to be preferably used in the present invention is a so-called contrasty developer, and includes a "rapid access" processing solution containing a dihydroxybenzene and a 1-phenyl-3-pyrazolidone (as described, e.g., in U.S. Pat. No. 4,172,728, etc.), a developer containing a dihydroxybenzene as a developing agent and utilizing the effect of polyethylene oxide to make the tone contrasty (e.g., infectious developer, processing solution described in U.S. Pat. No. 4,452,882, etc.), and the like.

Use of an infectious developer (e.g., a lithographic developer) is particularly preferably used in the present invention. It fundamentally comprises o- or p-dihydroxybenzene, an alkali agent, a small amount of free sulfurous acid salt, sulfite ion buffer, etc. The o- or p-dihydroxybenzene used as a developing agent may be appropriately selected from those well known in the photographic field. Specific examples thereof include hydroquinone, chlorohydroquinone, bromohydroquinone, isopropylhydroquinone, toluhydroquinone, methylhydroquinone, 2,3-dichlorohydroquinone, 2,5-dimethylhydroquinone, etc. Of these, hydroquinone is very practical. These developing agents are used alone or in combination. They are added in amounts of 1 to 100 g, preferably 5 to 80 g, per liter of the developer. The sulfite ion buffer is used in an amount sufficient to effectively keep the concentration of sulfite in the developer almost at a definite level, and examples are illustrated by aldehyde/alkali hydrogen sulfite adducts such as formalin/sodium hydrogensulfite, ketone/alkali hydrogensulfite adducts such as acetone/sodium hydrogensulfite, carbonyl busulfite/amine condensates such as sodium bis(2-hydroxyethyl)aminomethanesulfonate, etc. The sulfite ion buffer is used in an amount of 13 to 130 g per liter of the developer.

The free sulfite ion concentration of the developer can be controlled by adding an alkali sulfite such as sodium sulfite. The sulfite is generally added in an amount of 5 g or less, particularly 3 g or less, per liter of the developer, but may be added in an amount of more than 5 g per liter if desired.

In many cases, alkali halides (particularly, bromides such as sodium bromide, potassium bromide, etc.) are incorporated in the developer as development-adjusting agents. The alkali halide is added in an amount of from 0.01 to 10 g, and preferably from 0.1 to 5 g, per liter of the developer.

In order to keep pH of the developer at 9 or more (and preferably in the range of from 9.7 to 12.5), an alkali agent is added to the developer. As the alkali agent for ordinary developers, sodium carbonate or potassium carbonate is used in various amounts.

As a fixing solution, that of the ordinarily employed composition may be used.

As the fixing agent, organic sulfur compounds which are known to show fixing effect may be used as well as thiosulfates and thiocyanates.

The fixing solution may contain a water-soluble aluminum salt as a hardener.

The development processing may be conducted manually or by means of an automatic developing machine. In the case of using an automatic developing machine, there are no limitations as to conveying method (for example, roller conveying, a belt conveying, etc.), and conveying type automatic developing machines typically used in the art may be used. As to the composition of processing solutions and developing manner, reference may be made to U.S. Pat. Nos. 3,025,779, 3,078,024, 3,122,086, 3,149,551, 3,156,173, 3,224,356, 3,573,914, etc.

The present invention will now be illustrated in more detail by reference to the following examples, which, however, are not to be construed as limiting the present invention in any way.

EXAMPLE 1

A monodisperse silver bromochloride emulsion (silver bromide content: 20 mol%; average grain size: 0.26 μm) containing about $4\times10^{-8}$ mol/mol silver of rhodium was prepared by adding ammonium rhodium chloride upon formation of grains.

After washing this emulsion with water in a conventional manner, it was subjected to gold and sulfur sensitization processes, followed by adding 6-methyl-4-hydroxy-1,3,3a,7-tetraazaindene as a stabilizer. Then, foregoing compound (V-5) was added thereto in an amount of 5.0 mg/m$^2$. The thus prepared emulsion contained 45 wt% gelatin based on silver nitrate.

This emulsion was separated into equal portions, and, after adding various dyes as shown in Table 1, polyethylene oxide nonylphenyl ether containing 50 ethylene oxide units, a polymer latex described in Preparation formulation 3 of Japanese Patent Publication No. 5,331/70, and tartrazine (20 mg/m$^2$) were added, in sequence, to each portion.

On the other hand, to a gelatin solution for forming light-insensitive upper layers was added Dye F of the following structure in an amount of 10 mg/m$^2$ and a hardener of 1,2-bis(vinylsulfonylacetamido)ethane in an amount of 0.05 g/m$^2$.

Emulsion layers and the light-insensitive upper layers were coated on a polyethylene terephthalate film according to the simultaneous multi-coating method to obtain Sample Nos. 1 to 12 shown in Table 1. The coated silver amount was 3.5 g/m$^2$, and the coated gelatin amount of the light-insensitive upper layer was 1.0 g/m$^2$. Structural formula of Dye F:

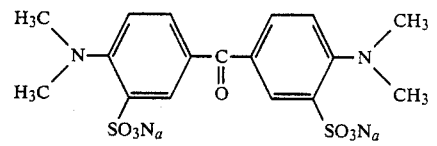

The thus prepared samples were exposed for 5 seconds through a step wedge of 0.1 in step difference. The exposed samples were developed at 38° C. for 20 seconds or at 27° C. for 100 seconds using the following developer 1 or 2, then subjected to ordinary fixing, washing, and drying.

Developer 1 (38° C., 20 seconds) (rapid access developer)

| | |
|---|---|
| Sodium carbonate | 11 g |
| Potassium bromide | 3 g |
| Hydroquinone | 23 g |
| 1-Phenyl-3-pyrazolidone | 0.4 g |
| Sodium sulfite | 67 g |
| Potassium hydroxide | 11 g |
| Water to make | 1 liter |

Developer 2 (27° C., 100 sec.) (infectious developer)

| | |
|---|---|
| Sodium carbonate | 50 g |
| Formaldehyde/sulfurous acid adduct | 45 g |
| Potassium bromide | 2 g |
| Hydroquinone | 18 g |
| Sodium sulfite | 2 g |
| Water to make | 1 liter |

Halftone dots were obtained by exposing the samples so that 50% halftone dots were obtained by contact printing using a tungsten light exposing machine through a 50% cross screen prepared using commercially available Fuji Ortho Film VO-100 (made by Fuji Photo Film Co., Ltd.), then developing in the same manner as described above.

Results thus obtained are shown in Table 1.

In Table 1, the safelight fog value is a value obtained by developing the sample, having been irradiated for 16 minutes by a 40-W bulb at a distance of 50 cm through Kodak Yellow Safelight OO (Wratten OO), in the same manner as described above.

In Table 1, the relative sensitivity is a relative value of the reciprocal of an exposure amount giving a black density of 1.5, taking the sensitivity of Sample 7 in Example 2 having been subjected to one of the aforesaid two development processing as 100. The Gamma value was calculated according to the following formula determining relative exposure amounts, log $E_1$ and log $E_2$ giving a black density (D) of $D_1$=fog+0.1 and $D_2$=fog+3.5, respectively:

$$\text{Gamma} = \frac{D_2 - D_1}{\log E_2 - \log E_1}$$

Dot quality was visually evaluated into 5 grades, with 5 showing the best quality, and 1 the worst. As a material for use in photomechanical process, a halftone dot quality of 5 or 4 indicates sufficiency for practical use, 3 indicates practically usable although somewhat poor, and 2 or 1 indicates that the materials are too poor for practical use.

Dyes 101 to 105, used in Sample Nos. 8 to 12, respectively, for comparison, are dyes of the following structures:

101

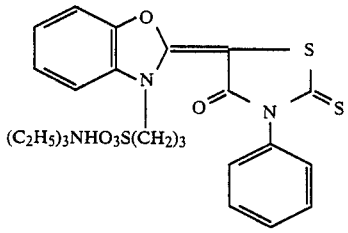

102

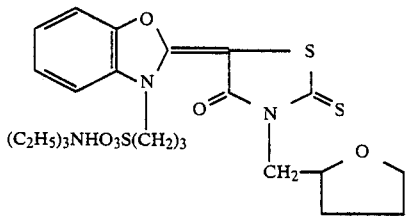

-continued

103

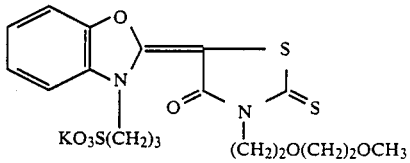

104

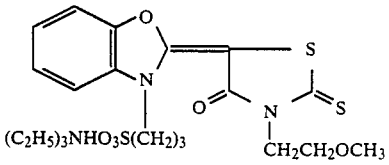

105

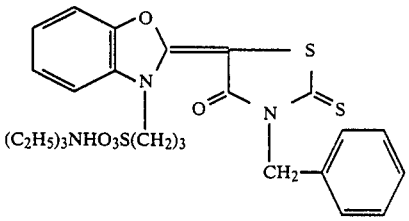

TABLE 1

| Sample | Dye | Amount of Added Dye (mg/m²) | Longer End of Spectrally Sensitized Region (nm) | Photographic Properties: Developer 1: Relative Sensitivity | Developer 1: Gamma | Developer 1: Fog | Developer 1: Halftone Dot Quality | Developer 2: Relative Sensitivity | Developer 2: Gamma | Developer 2: Fog | Developer 2: Halftone Dot Quality | Safelight Fog: Developer 1 | Safelight Fog: Developer 2 |
|---|---|---|---|---|---|---|---|---|---|---|---|---|---|
| 1 | None | — | 430 | 162 | 4.4 | 0.04 | 2 | 151 | 9.6 | 0.03 | 4 | 0.22 | 0.07 |
| 2 | 1-1 | 7.2 | 474 | 407 | 5.6 | 0.04 | 4 | 224 | 14.5 | 0.03 | 5 | 0.26 | 0.08 |
| 3 | 1-2 | 7.2 | 468 | 407 | 5.5 | 0.04 | 4 | 338 | 11.7 | 0.03 | 5 | 0.27 | 0.09 |
| 4 | 1-3 | 7.2 | 472 | 407 | 5.5 | 0.04 | 4 | 330 | 11.8 | 0.03 | 5 | 0.30 | 0.10 |
| 5 | 1-4 | 1.8 | 495 | 512 | 6.0 | 0.04 | 4 | 397 | 15.6 | 0.03 | 5 | 0.28 | 0.12 |
| 6 | 1-5 | 0.9 | 510 | 323 | 6.6 | 0.04 | 4 | 397 | 13.6 | 0.03 | 5 | 0.26 | 0.08 |
| 7 | 1-6 | 1.4 | 465 | 295 | 5.0 | 0.04 | 4 | 251 | 11.0 | 0.03 | 5 | 0.26 | 0.08 |
| 8 | 101 | 5.4 | 500 | 480 | 5.4 | 0.04 | 4 | 234 | 6.9 | 0.03 | 4 | 0.75 | 0.45 |
| 9 | 102 | 5.4 | 495 | 537 | 5.6 | 0.04 | 4 | 339 | 14.1 | 0.03 | 5 | 0.61 | 0.28 |
| 10 | 103 | 5.4 | 490 | 295 | 5.4 | 0.04 | 4 | 208 | 14.9 | 0.03 | 5 | 3.40 | 2.60 |
| 11 | 104 | 2.7 | 490 | 490 | 5.1 | 0.04 | 4 | 234 | 12.5 | 0.03 | 5 | 1.85 | 1.20 |
| 12 | 105 | 2.7 | 490 | 562 | 4.9 | 0.04 | 4 | 347 | 10.9 | 0.03 | 5 | 0.62 | 0.33 |

From the results given in Table 1, it is seen that Sample Nos. 2 to 7 containing dyes specified in the present invention showed high sensitivity and gave good halftone dot quality when processed with either of developer 1 and developer 2 and underwent less safelight fog.

In contrast, samples containing dyes outside the scope of the present invention underwent too serious safelight fog to be practically used though they were satisfactory in sensitivity and dot quality.

This difference in the effect on safe light fog is not in parallel with the value of longer wavelength end of spectral sensitization of used dye, thus being extremely difficult to expect. Further experiments using many dyes have failed to find effective dyes other than those specified by the present invention.

Results obtained by processing Samples 1 to 7 with the following Developer 3 at 38° C. for 20 seconds using an automatic developing machine (FG-25RA; made by Fuji Photo Film Co., Ltd.) are shown in Table 2.

Developer 3 (contrasty developer described in Japanese Patent Application (OPI) No. 190,943/83 having the following composition):

| | |
|---|---|
| Potassium bromide | 2.0 g |
| Potassium hydroxide | 20 g |
| Potassium carbonate | 35 g |
| Potassium sulfite | 80 g |
| Hydroquinone | 20 g |
| Triethylene glycol | 30 g |
| Polyethylene glycol (M.W. 400) | 2.0 g |
| 5-Nitroindazole | 0.1 g |
| Water to make (pH 11.7) | 1 liter |

TABLE 2

| Sample No. | Relative Sensitivity | Gamma | Fog | Halftone Dot Quality |
|---|---|---|---|---|
| 1 | 110 | 6.0 | 0.03 | 3 |
| 2 | 204 | 14.6 | 0.03 | 5 |
| 3 | 209 | 14.8 | 0.03 | 5 |
| 4 | 214 | 15.0 | 0.03 | 5 |
| 5 | 224 | 15.5 | 0.03 | 5 |
| 6 | 200 | 14.0 | 0.03 | 5 |
| 7 | 186 | 14.4 | 0.03 | 5 |

It is seen from the results given in Table 1 and 2 that the samples of the present invention are light-sensitive materials showing high sensitivity and giving contrasty photographic properties and good halftone dot quality for various contrasty developers.

EXAMPLE 2

Silver bromochloride emulsions A to G (content of silver bromide: 20 mol%) containing about $4\times10^{-8}$ mol/mol silver were prepared in the same manner as in Example 1 except for using the silver halide solvents as shown in Table 3 upon formation of the grains.

TABLE 3

| Emulsion | Silver Halide Solvent | Average Grain Size | C.V. Coefficient |
|---|---|---|---|
| A | II-12 | 0.26μ | 11.4 |
| B | II-1 | " | 9.4 |
| C | III-2 | " | 12.4 |
| D | IV-11 | " | 10.4 |
| E | — | " | 16.8 |
| F | — | 0.35μ | 18.6 |
| G | II-12 | " | 16.0 |

In Table 3, C.V coefficient is a coefficient of variance showing variance of grain size distribution, and is determined by the following general formula:

$$\text{C.V. } (\%) = \delta/\mu m \times 100$$

wherein

μm represents the average grain size and δ represents the standard deviation.

Dye I-1 was added to each emulsion in an amount of 7.2 mg/m², followed by multi-layer coating in the same manner as in Example 1, to prepare Sample Nos. 13 to 26.

Results obtained by exposing and developing these samples in the same manner as in Example 1 are set forth in Table 4.

TABLE 4

| | | | Photographic Properties | | | | | | | | | |
|---|---|---|---|---|---|---|---|---|---|---|---|---|
| | | | Developer 1 | | | | Developer 2 | | | | Safelight Fog | |
| Sample | Emulsion | Dye | Relative Sensitivity | Gamma | Fog | Half-tone Dot Quality | Relative Sensitivity | Gamma | Fog | Half-tone Dot Quality | Developer 1 | Developer 2 |
| 13 | A | No | 162 | 4.4 | 0.04 | 2 | 151 | 9.5 | 0.03 | 4 | 0.21 | 0.07 |
| 14 | B | " | 158 | 4.4 | 0.04 | 2 | 151 | 9.6 | 0.03 | 4 | 0.22 | 0.07 |
| 15 | C | " | 166 | 4.2 | 0.04 | 2 | 148 | 9.2 | 0.03 | 4 | 0.22 | 0.07 |
| 16 | D | " | 161 | 4.3 | 0.04 | 2 | 151 | 9.5 | 0.03 | 4 | 0.22 | 0.07 |
| 17 | E | " | 100 | 3.8 | 0.04 | 1 | 100 | 7.0 | 0.03 | 4 | 0.25 | 0.11 |
| 18 | F | " | 274 | 3.0 | 0.06 | 1 | 199 | 8.5 | 0.04 | 4 | 0.45 | 0.14 |
| 19 | G | " | 269 | 3.5 | 0.05 | 1 | 209 | 9.5 | 0.03 | 4 | 0.38 | 0.13 |
| 20 | A | Yes | 407 | 5.6 | 0.04 | 4 | 224 | 14.5 | 0.03 | 5 | 0.26 | 0.08 |
| 21 | B | " | 397 | 5.5 | 0.04 | 4 | 229 | 15.4 | 0.03 | 5 | 0.25 | 0.09 |
| 22 | C | " | 417 | 5.3 | 0.04 | 4 | 224 | 14.8 | 0.03 | 5 | 0.24 | 0.09 |
| 23 | D | " | 407 | 5.2 | 0.04 | 4 | 229 | 15.0 | 0.03 | 5 | 0.26 | 0.09 |
| 24 | E | " | 251 | 4.5 | 0.04 | 3 | 219 | 12.2 | 0.03 | 5 | 0.32 | 0.14 |
| 25 | F | " | 688 | 4.0 | 0.06 | 1 | 251 | 11.4 | 0.04 | 4 | 0.52 | 0.18 |
| 26 | G | " | 676 | 4.4 | 0.05 | 2 | 263 | 12.4 | 0.03 | 5 | 0.46 | 0.16 |

As is clear from Table 4, when the dye specified by the present invention was added to emulsions A to E having an average grain size specified by the present invention, high sensitivity and contrasty photographic properties were obtained and, in addition, safelight fog was not increased so much. Their effect was remarkable with emulsion A to D containing grains formed in the presence of the silver halide solvent. In contrast, emulsions F and G containing grains of large size, causing too serious safelight fog to be practically used.

Sample Nos. 17 and 20 to 23 were developed with developer 1 or 2 to examine development progress. The results are shown in Table 5. The results in Table 5 clearly show that, of the samples in accordance with the present invention, Sample Nos. 20 to 23 using emulsions A to D containing grains formed in the presence of the silver halide solvent showed early appearance of image and high sensitivity and gave contrasty properties. Even after much development, their properties were maintained, that is, showed a wide development latitude.

TABLE 5

| | Developer 1 (38° C.) | | |
|---|---|---|---|
| | 10 seconds | 20 seconds | 30 seconds |

TABLE 5-continued

| Sample | Emulsion | Relative Sensitivity | Gamma | Fog | Relative Sensitivity | Gamma | Fog | Relative Sensitivity | Gamma | Fog |
|---|---|---|---|---|---|---|---|---|---|---|
| 17 | E | 79 | 3.0 | 0.04 | 100 | 3.8 | 0.04 | 110 | 4.0 | 0.04 |
| 20 | A | 346 | 5.2 | 0.04 | 407 | 5.6 | 0.04 | 437 | 5.8 | 0.04 |
| 21 | B | 347 | 5.2 | 0.04 | 398 | 5.5 | 0.04 | 427 | 5.8 | 0.04 |
| 22 | C | 355 | 4.9 | 0.04 | 417 | 5.3 | 0.04 | 447 | 5.6 | 0.04 |
| 23 | D | 354 | 4.3 | 0.04 | 457 | 5.2 | 0.04 | 437 | 5.4 | 0.04 |
| 24 | E | 199 | 4.2 | 0.04 | 251 | 4.5 | 0.04 | 263 | 4.7 | 0.04 |
| 25 | F | 546 | 3.1 | 0.05 | 688 | 4.0 | 0.06 | 724 | 4.2 | 0.08 |
| 26 | G | 575 | 3.3 | 0.04 | 676 | 4.4 | 0.05 | 741 | 4.5 | 0.06 |

| | | Developer 2 (27° C.) | | | | | | | | |
|---|---|---|---|---|---|---|---|---|---|---|
| | | 80 seconds | | | 100 seconds | | | 120 seconds | | |
| Sample | Emulsion | Relative Sensitivity | Gamma | Fog | Relative Sensitivity | Gamma | Fog | Relative Sensitivity | Gamma | Fog |
| 17 | E | 71 | 5.6 | 0.03 | 100 | 7.0 | 0.03 | 117 | 6.4 | 0.03 |
| 20 | A | 191 | 13.5 | 0.03 | 224 | 14.5 | 0.03 | 240 | 14.6 | 0.03 |
| 21 | B | 190 | 14.2 | 0.03 | 229 | 15.4 | 0.03 | 251 | 15.0 | 0.03 |
| 22 | C | 188 | 13.8 | 0.03 | 224 | 14.8 | 0.03 | 245 | 14.5 | 0.03 |
| 23 | D | 195 | 14.5 | 0.03 | 229 | 15.0 | 0.03 | 245 | 14.8 | 0.03 |
| 24 | E | 174 | 11.6 | 0.03 | 219 | 12.2 | 0.03 | 240 | 12.0 | 0.03 |
| 25 | F | 178 | 7.5 | 0.03 | 251 | 11.4 | 0.04 | 295 | 9.0 | 0.04 |
| 26 | G | 220 | 10.4 | 0.03 | 263 | 12.4 | 0.03 | 295 | 11.5 | 0.03 |

In addition, results obtained by processing Sample Nos. 17 and 20 to 26 with the foregoing developer 3 (38° C., 20 sec.) are shown in Table 6.

TABLE 6

| Sample | Emulsion | Relative Sensitivity | Gamma | Fog | Halftone Dot Quality |
|---|---|---|---|---|---|
| 17 | E | 100 | 6.5 | 0.03 | 4 |
| 20 | A | 200 | 16.0 | 0.03 | 5 |
| 21 | B | 209 | 15.4 | 0.03 | 5 |
| 22 | C | 195 | 17.5 | 0.03 | 5 |
| 23 | D | 204 | 16.5 | 0.03 | 5 |
| 24 | E | 204 | 14.6 | 0.03 | 5 |
| 25 | F | 214 | 10.2 | 0.04 | 4 |
| 26 | G | 224 | 9.6 | 0.03 | 4 |

It is seen from the results in Table 4 and 6 that, in the case of using emulsions containing grains formed in the presence of silver halide solvent, particularly excellent halftone dot quality was obtained for various contrasty developers together with high sensitivity and contrasty photographic properties, due to use of the dye of the present invention.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic light-sensitive material, comprising a monodisperse silver halide emulsion of 0.30 μm or less in average silver halide grain size containing at least 75 mol%, silver chloride and 2 mol% or less silver iodide, and having incorporated in said emulsion a dye represented by formula (I)

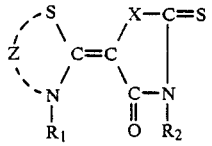

(I)

wherein

Z represents atoms forming a thiazoline nucleus, a thiazole nucleus, or a benzothiazole nucleus, X represents an oxygen atom or a sulfur atom, and $R_1$ and $R_2$ each represents an unsubstituted or substituted aliphatic group or an unsubstituted or substituted aromatic group.

2. A silver halide photographic light-sensitive material as in claim 1, wherein $R_1$ and $R_2$ each represents an alkyl group containing from 1 to 5 carbon atoms or a phenyl group or a naphthyl group.

3. A silver halide photographic light-sensitive material as in claim 1, wherein the dye represented by formula (I) is used in an amount of from 10 mg to 600 mg per mol of silver halide in said silver halide emulsion.

4. A silver halide photographic light-sensitive material as in claim 2, wherein the dye represented by formula (I) is used in an amount of from 10 mg to 600 mg per mol of silver halide in said silver halide emulsion.

5. A silver halide photographic light-sensitive material as in claim 1, wherein the dye represented by formula (I) is used in an amount of from 100 mg to 400 mg per mol of silver halide in said silver halide emulsion.

6. A silver halide photographic light-sensitive material as in claim 2, wherein the dye represented by formula (I) is used in an amount of from 100 mg to 400 mg per mol of silver halide in said silver halide emulsion.

7. A silver halide photographic light-sensitive material as in claim 1, wherein said silver halide emulsion contains silver halide grains formed or ripened in the presence of a silver halide solvent.

8. A silver halide photographic light-sensitive material as in claim 7, wherein said silver halide solvent is a tetra-substituted thiourea compound represented by formula (II)

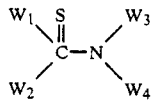

(II)

wherein $W_1$, $W_2$, $W_3$, and $W_4$ each represents a substituted or unsubstituted alkyl group, a substituted or unsubstituted alkenyl group, or a substituted or unsubstituted aryl group, with the sum of the carbon atoms in $W_1$ through $W_4$ being up to 30, or $W_1$ and $W_2$, $W_2$ and $W_3$, or $W_3$ and $W_4$, taken together, represent a 5- or 6-membered heterocyclic ring.

9. A silver halide photographic light-sensitive material as in claim 7, wherein said silver halide solvent is an organic thioether compound.

10. A silver halide photographic light-sensitive material as in claim 7, wherein said silver halide solvent is a compound represented by formula (IV)

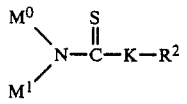

(IV)

wherein K represents a sulfur atom or an oxygen atom;

$M^0$ and $M^1$ each represents an aliphatic group, an aryl group, a hetero ring residue, or an amino group, or $M^0$ and $M^1$ together form a 5- or 6-membered hetero ring, $R^2$ represents an unsubstituted or substituted alkyl group containing from 1 to 4 carbon atoms or an unsubstituted or substituted aryl group.

11. A silver halide photographic light-sensitive material as in claims 1, wherein said silver halide emulsion contains a rhodium salt.

12. A silver halide photographic light-sensitive material as in claim 11, wherein said rhodium salt is used in an amount of from $1\times10^{-10}$ to $1\times10^{-5}$ mol.

13. A silver halide photographic light-sensitive material as in claim 11, wherein said rhodium salt is used in an amount of from $1\times10^{-8}$ to $1\times10^{-6}$ mol.

14. A silver halide photographic light-sensitive material as in claim 1, wherein said light-sensitive material further contains a 1,2-dithiolane ring-containing compound or a 1,2-dithiane ring-containing compound.

15. A silver halide photographic light-sensitive material as in claim 14, wherein said 1,2-dithiolane ring-containing compound or 1,2-dithiane ring-containing compound represented by formula (V)

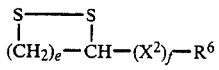

(V)

wherein $X^2$ represents a divalent organic residue containing from 1 to 6 carbon atoms;

$R^6$ represents a carboxylic acid, a carboxylic acid salt, a carboxylic ester, or a carboxylic acid amide;

e represents 2 or 3; and f represents 0 or 1.

16. A silver halide photographic light-sensitive material as in claim 15, wherein compound of formula (V) is present in an amount of from $10^{-6}$ to $10^{-1}$ mol per mol of silver halide.

17. A silver halide photographic light-sensitive material as in claim 15, wherein compound of formula (V) is present in an amount of from $10^{-5}$ to $10^{-2}$ mol per mol of silver halide.

18. A silver halide photographic light-sensitive material as in claim 1, wherein the 95% or more silver halide grains on a number basis of said monodisperse silver halide emulsion fall within ±40% of the average grain size.

* * * * *